US005240198A

United States Patent [19]

Dörfel

[11] Patent Number: 5,240,198

[45] Date of Patent: Aug. 31, 1993

[54] COMPLIANT ROLLER FOR A WEB WINDING MACHINE

[75] Inventor: Gerhard W. Dörfel, Boll, Fed. Rep. of Germany

[73] Assignee: Beloit Technologies, Inc., Wilmington, Del.

[21] Appl. No.: 777,956

[22] Filed: Nov. 29, 1991

[51] Int. Cl.[5] ..... B65H 18/10; B65H 18/16; B65H 18/20

[52] U.S. Cl. ..... 242/65; 242/66; 242/67.1 R

[58] Field of Search ..... 242/65, 66, 67.1 R, 242/67.2, 75.2

[56] References Cited

U.S. PATENT DOCUMENTS

| | | | |
|---|---|---|---|
| 2,980,356 | 4/1961 | Beese et al. | 242/56 R |
| 3,098,619 | 7/1963 | Washburn | 242/66 |
| 3,182,924 | 5/1965 | Jones et al. | 242/68 |
| 3,224,698 | 12/1965 | Conti | 242/55 |
| 3,702,687 | 11/1972 | Hall | 242/65 X |
| 3,706,119 | 12/1972 | Collet | 29/113 |
| 4,026,487 | 5/1977 | Ales, Jr. | 242/65 |
| 4,193,559 | 3/1980 | Ballard | 242/67.1 R |
| 4,372,247 | 2/1983 | Calabrese | 118/116 |
| 4,541,585 | 9/1985 | Frye et al. | 242/66 |
| 4,842,209 | 6/1989 | Saukkonen | 242/56 R |
| 4,883,233 | 11/1989 | Saukkonen et al. | 242/66 |
| 4,883,715 | 11/1989 | Kuge et al. | 428/421 |
| 4,921,183 | 5/1990 | Saukkonen et al. | 242/66 |
| 5,023,985 | 6/1991 | Salo et al. | 29/132 |

FOREIGN PATENT DOCUMENTS

| | | |
|---|---|---|
| 230633 | 8/1987 | European Pat. Off. . |
| 1716516 | 2/1956 | Fed. Rep. of Germany . |
| 1527650 | 3/1970 | Fed. Rep. of Germany . |
| 2237949 | 3/1973 | Fed. Rep. of Germany . |
| 7723702 | 7/1977 | Fed. Rep. of Germany . |
| 2605268 | 8/1977 | Fed. Rep. of Germany . |
| 3823655 | 1/1990 | Fed. Rep. of Germany . |
| 417769 | 10/1934 | United Kingdom . |
| 419133 | 11/1934 | United Kingdom . |

*Primary Examiner*—John M. Jillions

*Attorney, Agent, or Firm*—Dirk J. Veneman; Raymond W. Campbell; Gerald A. Mathews

[57] ABSTRACT

A roller (10) used as support, backing or driven roller in winding devices, such as winders for winding wound rolls of paper coming from a papermaking machine, is composed of an outer cylindrical roller element (24), on which an elastic, flexible intermediate layer (26) of elastomeric material is applied. On the intermediate layer (26), an external roller mantle (33) of thin-wall spring steel is provided that can be deformed in a plane perpendicular to the axis due to the contact pressure of the roll (2) and can be pressed against the outer perimeter of the roll (2). A broad contact region is created, which leads to a lower specific nip pressure and to a lower roll hardness. Channels (27, 28) in the intermediate layer (26) serve to increase the flexibility and cooling.

9 Claims, 2 Drawing Sheets

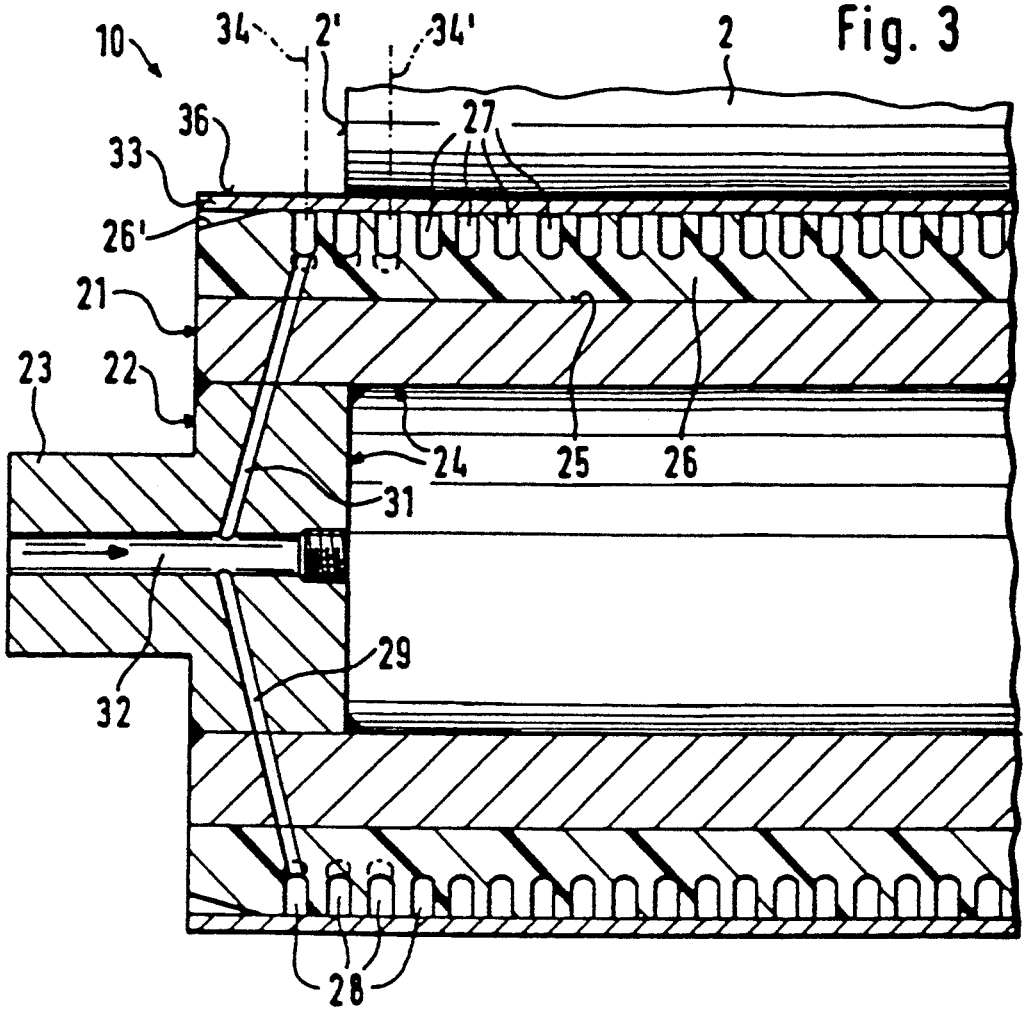
Fig. 3
Fig. 4
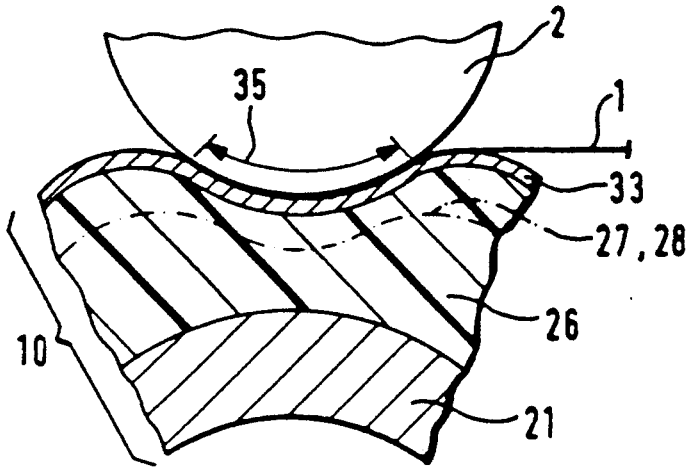

COMPLIANT ROLLER FOR A WEB WINDING MACHINE

Winding devices for paper sheeting are known in various designs, where rollers are in contact with the roll being wound parallel to its axis. The roll of wound paper web of the transportation roller rests on two parallel support rollers operating at the same height and is driven from above by a drive roller. The roll on the backing roller is rotary seated on a shaft which, in turn, is mounted to pivot arms. The roll is in contact with a backing roller. As the diameter of the roll increases, the axis of the roll moves away from the fixed backing roller as the pivot arms move outward. The designs can have different details. But they all have in common, in connection with the invention, that an axis-parallel roller is in contact with the roll being wound, for example, in the form of the mentioned support rollers, backing rollers or driving rollers.

In many cases, it is important to produce the roll of paper sheet with the smallest possible winding stresses. To do this, besides the application of the smallest possible path tension, it is also necessary to use the smallest possible specific nip pressure. The nip pressure, that is, the contact pressure of the roller against the roll being wound, is also responsible for the tensions in the sheet. If the roller in contact with the roll is practically inelastic, as is the case, for example, for a thick-wall steel roller, then the contact region is relatively narrow and is determined only by the flexibility of the roll itself. The contact force is then distributed onto a small surface, and the resultant specific pressure is large. The resultant stresses in the sheet then lead to a large package hardness that is often undesirable.

Now we have already mentioned the so-called elastic rollers, that is, rollers with a supporting cylindrical roller element at the outer perimeter; they have a coating made of rubber or another elastomer. When using these rollers as supporting, backing or driven rollers, due to the contact pressure, not only is the roll deformed but also the material of the roller coating. Its shape adapts somewhat to that of the roll. The roll is to a certain extent pressed into the soft surface of the roller. This, then, will increase the contact area in the circumferential direction and reduces the specific contact pressure, which, in itself, is desirable. But at the same time, due to the deformation of the roller coating at the edge of the roll, an axial stress on the paper sheet in the longitudinal direction of paper web travel is created; this is not desirable because it affects the quality of the roll. Rollers with an elastic coating operating directly against the roll, thus, provide no advantages compared to the production of wound paper rolls of low hardness.

Thus, the invention is based on the problem of designing a winding device so that it can produce rolls of lesser hardness, without affecting the other roll properties.

This problem is solved in the first place by providing a support, backing or so-called drive drum in a winder for winding an on-coming paper web wherein the drum has a relatively hard outer surface which encloses and is supported by a radially elastically deformable layer of elastomeric material. In a preferred embodiment, the outer surface comprises a hollow, flexible cylindrical mantle of thin steel.

The basic idea here is that the thin-wall rolling mantle is made of metal that is easily deformed in the circumferential direction; that is, it can be easily dented or depressed, and, thus, the desirable increase in the contact area in the circumferential direction and, thus, the reduction in specific contact pressure will be possible. But at the same time, the thin-wall rolling mantle made of metal is barely or not deformable in the axial direction, along a circumferentially extending arcuate segment of the roller surface in contrast to an elastomer or even a rubber mantle, and thus does not affect the roll quality because no axial forces are produced.

Rollers with an elastic, flexible intermediate layer and thin-wall metallic roller mantle are known. For example, DE-GM 77 23 702 shows a rotation element designed with very small inertial moment about the longitudinal axis. This rotation element is to be used, for instance, as a non-driven roller to guide sheet-like materials, such as textile sheet, paper sheet, metal foils and similar items. On a rotating shaft (4), a cylindrical region with a low-density filler is provided which is surrounded by a metal mantle with a wall thickness of 0.03 to 0.5 mm forming the perimeter of the operating roller. It can be produced electrochemically or by rolling of metal foils.

From DE-OS 22 37 949, a roller with a roller element is known that is surrounded by an intermediate layer of filler containing bubble material, for example, foamed rubber materials or elastomers. A metallic roller mantle is located on the intermediate layer. The rollers should be used, for example, for calendering of textile products.

The invention is also embodied in an application of a roller of the type used as a supporting, backing or driven roller in winding devices for paper or similar articles.

In the preferred design of the invention, the intermediate layer consists of a compact, elastomeric material with a Shore A hardness of 30° to 80°.

In this design, the entire system of the roller in contact with the roll is still stable enough to counteract undesirable vibration at the usually large operating speed. The metallic, rolling mantle of the roller is best if made of steel and can have a radial thickness of 1 to 5 mm.

A third aspect of the invention configured in the form of a single roller suitable for winding devices.

The rolling mantle of the roller can be made of spring steel because this steel has a particularly large range of elasticity and can adapt easily to the configuration of the roller without coming near the yield point.

The sizing of the radial thickness of the intermediate layer depends essentially on the particular case. It must be thick enough to allow adaptation of the elastically deformable rolling mantle to the perimeter of the roll without generating excessive elongations. The thickness needed for this will depend on the contact pressure and on the diameter of the roll being produced. The range coming into consideration for practical applications lies between 10 and 100 mm.

An important configuration of the invention consists in the fact that channels of at least 10 $mm^2$ are distributed in the intermediate layer along the perimeter.

The channels should have a macroscopic cross-section and not be designed as pores or similar features. They have a double function. First, they increase the flexibility of the overall configuration because the elastically flexible material of the intermediate layer—when the adjacent channel walls remaining between the channels are deformed, in turn, by the corresponding deformation of the roller mantle—can more easily escape to the side. The other function is a cooling function. During rotating of the roller, a considerable flexing operation is performed in the material of the intermediate layer due to the deformation occurring for each revolution. Now, unless the proper precautions are taken, this flexing operation will result in excessive heat-up of the elastic, flexible material. This is counteracted by the coolant.

Accordingly, the grooves can be formed in the surface of the intermediate layer and can be open toward the interior of the roller mantle. This will make the production easier. The grooves can be provided as circumferential grooves, especially as screw-shaped perimeter grooves so that the coolant can be rather easily distributed over the entire circumferential surface. In multi-path designs, it is possible to move the coolant back and forth. If intersecting perimeter grooves are used, a waffle- or rhombic-shaped structure is obtained.

Since it is particularly important to avoid axial forces in the region of the edges of the roll, and the flexibility of the rolling mantle should be particularly large there, it can be recommended to make the grooves in the region of the edge of the working region deeper and/or wider than in the middle of the working region.

The elastically flexible material of the intermediate layer can be tapered axially outside the operating region from the roller mantle outward toward the axis in order to increase the fatigue limit of the apparatus.

Since the paper is often filled with mineral strips and are abrasive, and, thus, the width of the nip in the circumferential direction of the roller may have local shifts of the paper sheet with respect to the perimeter, it may be a good idea to coat the roller mantle on the outer perimeter with a wear-reducing material, for example, a hard-metal coating. This type of coating also has the function of increasing the coefficient of friction between the roller mantle and the paper or other sheet material in order to transfer greater circumferential forces to the roll without increasing the contact pressure.

BRIEF DESCRIPTION OF THE DRAWINGS

The figures show one sample design of the invention.

FIG. 3 shows a longitudinal cross-section through one end of the roller used as support, backing or driven roller;

FIG. 4 illustrates the deformation effect produced by the invention as the wound paper roll is supported by the compliant roller (greatly exaggerated).

DETAILED DESCRIPTION OF THE DRAWINGS

Figure 1:
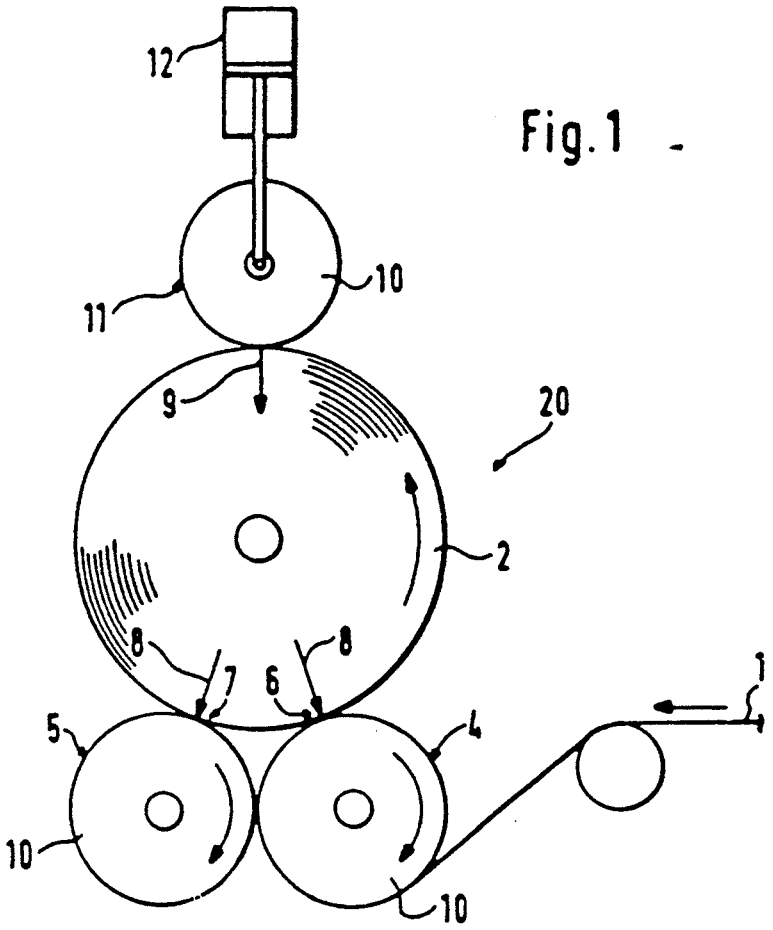
FIGS. 1 and 2 show winding devices schematically in a cross-section running perpendicular to the axis of the rollers.

In FIG. 1, we see a support roller roll-device 20 that is used to roll up a paper sheet 1 onto a roll 2. The product sheet 1 is being moved forward under a certain longitudinal sheet tension and is diverted downward by means of a diverter, or guide, roller 3 according to FIG. 1. It rolls from below around driven support roller 4 with horizontal axis, next to which another support roller 5 of the same design, likewise with horizontal axis, is positioned at the same height and with little separation. The roll being wound 2 contacts the support rollers 4, 5 at points 6 and 7 with a nip pressure 8 that is obtained from the weight of the roll and the contact pressure 9 of a driven roller 11 that is located above the support rollers 4, 5 and symmetrically to them and stands under the force of one piston/cylinder unit 12. The driven roller 11 serves to guide the quickly revolving roll and to ensure a uniform formation of said roll.

Figure 2:
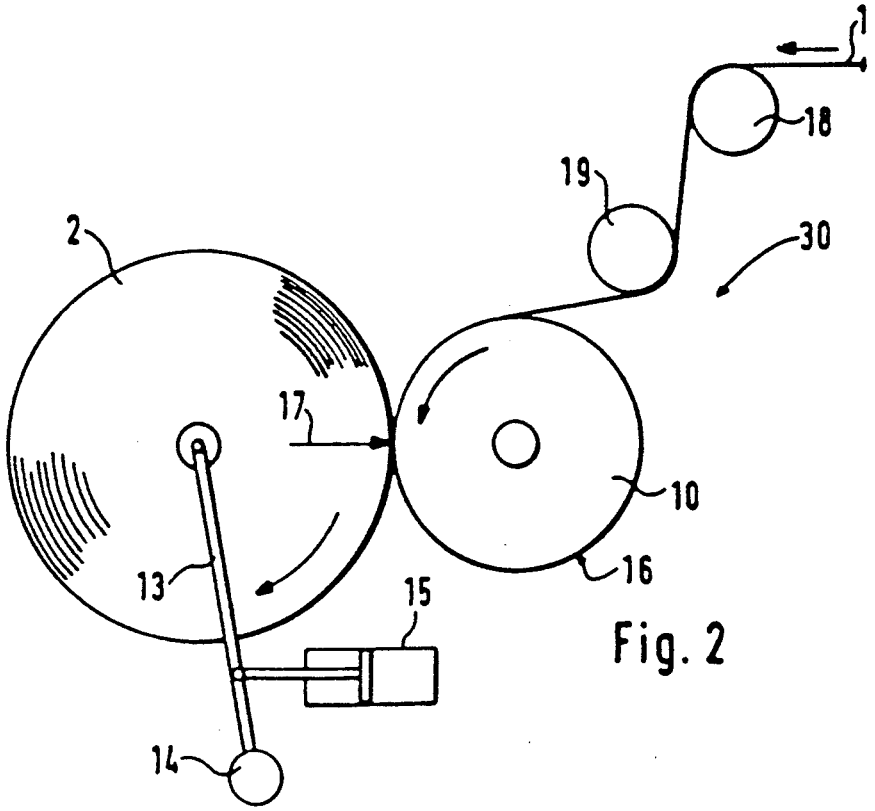

FIG. 2 shows a support roller winding device where the product sheet 1 is being rolled up into a roll 2 that is not in contact with support rollers but rather is seated on a shaft on pivot arms 13 that stand essentially upright and are pivot-mounted at the bottom at point 14. Due to piston/cylinder units 15 articulated with the pivot arms 13, the roll 2 is pulled against a support roller 16 fixed in position at about the same height. A nip pressure 17 is produced. The paper sheet 1 moves from above via diverter rollers 18, 19 onto the support roller 16 and, after passing of the nips, is rolled onto the roll 2.

Thus, the rollers 4, 5, 11, 16 are in contact in the nips with the nip pressures 8, 9, 17 at the roll 2, and due to their surface behavior, they determine the package hardness of roll 2. The rollers 4, 5, 11, 16 are, thus, essentially of the same design and are given by rollers 10 whose inner design is visible in FIG. 3. The roller 10 is composed of a cylindrical, hollow roller 21 in which a rotation-symmetrical end piece 22 is inserted at the ends, for example, it is welded in, and extends outward past the end of the hollow roller 21 and there forms the roller journal 23. These parts together form the roller element 24. The illustrated configuration is sufficient when the length of the roller 10 is not too large and the load is not too great. In other cases, the hollow roller 21 can be a part of a hydraulic, internal-braced roller, for example, of a flexural-controlled roller according to DE-OS 22 30 139, for instance.

The outer perimeter 25 of the roller element 24 is cylindrical. An intermediate layer 26 made of a compact, elastic, flexible polyurethane with Shore A hardness of 50° is attached to the outer perimeter 25. The wall thickness corresponds to that of the cylindrical roller tube 21 and amounts to about 30 mm. In the outer perimeter of the intermediate layer 26, there are screw-shaped circumferential grooves 27, 28 whose width is about 4 mm and whose depth is about 12 mm. In the sample design, the perimeter grooves 27, 28 form a two-thread screw. The two-screw threads formed by the perimeter grooves 27 or 28 are connected by means of connecting holes 29, 31 to a central drilled hole 32 in the roller lug 23 through which a coolant, for example, air or water, can be fed, which is pumped through the perimeter grooves 27, 28 from left to right in FIG. 3. The roller 10 is appropriately designed at the right end and contains a drain line there for the coolant. Other liquid lines are also known. It is important only that the perimeter grooves 27, 28 be distributed uniformly along the perimeter and that they be relatively closely packed together.

The cylindrical, outer perimeter of the intermediate layer 26 is covered by a thin-wall roller mantle 33 of spring steel of about 2 mm radial thickness that is braced against the intermediate layer 26 and covers it over its entire surface. In addition, the downward open grooves 27, 28 that have an essentially rectangular cross-section with rounded bottom are closed off on the outside by the roller mantle 33.

In the top part of FIG. 3, we see the lower portion of the roll 2 that is in contact with the roller mantle 33. Its left boundary edge in FIG. 3 can shift or migrate between the bounds 34 and 34'. The grooves 27, 28 can be deeper and perhaps also wider in this region, as indicated by the dashed lines, in order to ensure a particularly elastic flexibility of the entire configuration in the edge region of the roll.

The roller mantle 33 rests essentially over the entire length of the roller and is securely touching the intermediate layer 26. But at the ends, the outer perimeter of the intermediate layer 26 moves inward at 26' away from the inner perimeter of the roller mantle 33. This feature is used to increase the flexibility and to prevent destruction due to edge effects.

The outside of the roller mantle 33 has a coating 36 of hard metal in order to counteract the long-term, abrasive effect of the paper sheet 1 and to increase the coefficient of friction between the roller mantle 33 and the paper sheet 1.

The effect of the invention is shown in FIG. 4 (exaggerated). The roller 10 is relatively easy to deform in a plane perpendicular to the axis because the roller mantle 33 is made of thin, spring steel and is only elastically supported by the intermediate layer 26. The roller mantle 33 is, thus, pushed in somewhat in the manner shown in FIG. 4 and touches the perimeter of the roll in the nip in a contact area 35 which is relative broad, due to the contact; at any rate, it is broader than it would be for an entirely rigid counter-roller. The contact force occurring per length unit is thus distributed to this relatively large contact area 35 so that a rather low, specific nip pressure is generated which will assist in the formation of a low wound roll hardness, which, in many cases, is desirable.

Only quite insignificant changes in length parallel with the longitudinal axis of rotation of the backing or support roller are connected with the deformation in the plane perpendicular to the axis, as is evident in FIG. 4, so that the roll 2 is not placed under stress in the region of its edge 2', and the roll quality at the edge is not reduced.

I claim:

1. Apparatus for winding a roll from a traveling paper web, the apparatus including at least one roller for supporting, backing or driving the paper roll being wound, the roller comprising:

a body having a cylindrical outer surface and a longitudinal axis of rotation;

a hollow, flexible, cylindrical mantle disposed about the body coaxially therewith;

a cylindrical, hollow, radially elastically deformable intermediate layer positioned about the body and extending continuously therewith, enclosed by, and supporting, the mantle thereabout;

a plurality of circumferentially extending, closely spaced channel walls defining channels are formed in the intermediate layer, the channel walls extending outwardly and bearing against the inner circumferential surface of the mantle such that the channels are open to the inner circumferential surface of the mantle.

2. Apparatus for winding a wound roll from a traveling paper web, the apparatus including at least one roller for supporting, backing or driving the paper roll being wound, the roller comprising:

a body having a cylindrical outer surface and a longitudinal axis of rotation;

a hollow, flexible, cylindrical mantle disposed about the body coaxially therewith, said mantle comprising a steel cylinder having a thickness of between about 1 mm to about 5 mm such as to be elastically deformable in the radial direction of the roller;

a cylindrical, hollow, radially elastically deformable intermediate layer positioned about the body and extending continuously therewith, enclosed by, and supporting, the mantle thereabout, the intermediate layer comprising a compact elastomeric material having a Shore "A" hardness of between about 30 to about 80;

a plurality of circumferentially extending, closely spaced channel walls defining channels are formed in the intermediate layer, the channel walls extending outwardly and bearing against the inner circumferential surface of the mantle such that the channels are open to the inner circumferential surface of the mantle.

3. Apparatus for winding a wound paper web roll, as set forth in claim 2, wherein:

the intermediate layer has a radial thickness of between about 10 mm to about 100 mm.

4. Apparatus for winding a wound paper web roll, as set forth in claim 2, wherein:

the channels distributed over the perimeter of the intermediate layer are formed such that their cross-sectional area is at least 10 $mm^2$.

5. Apparatus for winding a wound paper web roll, as set forth in claim 2, wherein:

the roller further includes journal means extending axially outwardly from either end of the body; and further including cooling fluid holes formed in the body and the journal means at least at one end of the roll for connecting the channels to a source of coolant outside of the roller whereby coolant can be circulated through the channels and out of the roller.

6. Apparatus for winding a wound paper web roll, as set forth in claim 2, wherein:

the channels comprise grooves having curved bottoms provided on the outer periphery of the intermediate layer, which grooves are open toward the mantle.

7. Apparatus for winding a wound paper web roll, as set forth in claim 2, wherein:

the channels extend continuously in a helical pattern about the roller for substantially the entire longitudinal length thereof.

8. Apparatus for winding a wound paper web roll, as set forth in claim 2, wherein:

the channels are deeper and/or wider in the region of the edge of the roller compared to their depth and/or width intermediate the edge regions of the roller.

9. Apparatus for winding a roll from a traveling paper web, the apparatus including at least one roller for supporting, backing or driving the paper roll being wound, the roller comprising:

a body having a cylindrical outer surface and a longitudinal axis of rotation;

a hollow, flexible, cylindrical mantle disposed about the body coaxially therewith, said mantle comprising a steel cylinder having a thickness of between about 1 mm to about 5 mm such as to be elastically deformable in the radially direction of the roller;

a cylindrical, hollow, radially elastically deformable intermediate layer positioned about the body and extending continuously therewith, enclosed by, and supporting, the mantle thereabout, the intermediate layer having a radial thickness of between about 10 mm to about 100 mm and comprising a compact, elastomeric material having a Shore "A" hardness of from about 30 to about 80.

* * * * *